US006915614B2

(12) United States Patent
Matsufuji

(10) Patent No.: US 6,915,614 B2
(45) Date of Patent: Jul. 12, 2005

(54) BRICKLAYING STRUCTURE, BRICKLAYING METHOD, AND BRICK MANUFACTURING METHOD

(75) Inventor: Yasunori Matsufuji, Fukuoka (JP)

(73) Assignee: Japan Science and Technology Agency, Saitama (JP)

( * ) Notice: Subject to any disclaimer, the term of this patent is extended or adjusted under 35 U.S.C. 154(b) by 0 days.

(21) Appl. No.: 10/363,128

(22) PCT Filed: Sep. 5, 2001

(86) PCT No.: PCT/JP01/07681

§ 371 (c)(1),
(2), (4) Date: Mar. 6, 2003

(87) PCT Pub. No.: WO02/20913

PCT Pub. Date: Mar. 14, 2002

(65) Prior Publication Data

US 2004/0020145 A1 Feb. 5, 2004

(30) Foreign Application Priority Data

Sep. 6, 2000 (JP) ..... 2000-270219

(51) Int. Cl.[7] ..... E04C 2/04

(52) U.S. Cl. ..... 52/600; 52/606; 52/585.1; 52/747.1; 52/285.2

(58) Field of Search ..... 52/600, 606, 585.1, 52/285.2, 747.1, 248, 747.12, 565, 562, 605, 233

(56) References Cited

U.S. PATENT DOCUMENTS 4,823,528 A * 4/1989 Faw ..... 52/233
6,282,859 B1 * 9/2001 Van Der Heijden ..... 52/585.1
6,557,316 B2 * 5/2003 Van Der Heijden ..... 52/585.1

FOREIGN PATENT DOCUMENTS

| | | | |
|---|---|---|---|
| JP | 57-205658 | * 12/1982 | ..... 52/585.1 |
| JP | 57205658 | * 12/1982 | ..... 52/585.1 |
| JP | 02-058677 | 2/1990 | |
| JP | 05-255982 | 10/1993 | |
| JP | 06-299621 | 10/1994 | |
| JP | 07-229215 | 8/1995 | |
| JP | 09-021199 | 1/1997 | |
| JP | 09-235801 | 9/1997 | |

* cited by examiner

*Primary Examiner*—Naoko Slack
(74) *Attorney, Agent, or Firm*—Jacobson Holman PLLC

(57) ABSTRACT

A bricklaying structure, a bricklaying method and a brick manufacturing method that is adaptable to a variety of architectural details. Each brick is provided with a bolt hole and through-holes. The bolt hole has a diameter which allows a bolt to extend therethrough and the through-hole has a diameter for containing a nut. The bolt hole and through-holes are arranged on a longitudinal center line of the brick, and a center of the bolt hole, centers of the through-holes and respective end faces of the brick are spaced apart an equal distance from each other in a longitudinal direction of the brick. The bricks and metallic plates are vertically stacked and the bricks are integrally connected under pre-stress with each other by tightening the bolts extending through the vertical bolt holes.

14 Claims, 14 Drawing Sheets

(A)

(B)

BRICKLAYING STRUCTURE, BRICKLAYING METHOD, AND BRICK MANUFACTURING METHOD

TECHNICAL FIELD

The present invention relates to a bricklaying structure, bricklaying method and brick manufacturing method, and more specifically, to such structure and methods desirably adaptable to architectural details, e.g., corner part, opening part and columnar part.

TECHNICAL BACKGROUND

Various kinds of building construction methods are known in the art, such as wooden, reinforced concrete, steel and block masonry construction methods. As a kind of such construction methods, a bricklaying method is known, in which a brick wall structure is constructed by bricklaying. In general, bricks produced by baking brick clay at a high temperature are highly regarded in architectural design effects or aesthetic effects resulting from their textures, stately appearances, colors and so forth. The bricks also exhibit their excellent physical performances with respect to durability, sound insulation effect, fire resistance efficiency, heat accumulation effect and so forth. Therefore, the bricks have been popularly used worldwide for a long time and widely employed as materials for architectural wall structures.

A conventional bricklaying construction method is a kind of wet construction method, in which bricks are built-up in multiple steps or layers with use of a bonding material such as cement mortar and an appropriate reinforcement such as wire meshes, steel bars or the like. Therefore, the evaluation of construction works with regard to its quantity and quality substantially relies on the skill and technique of bricklayer. Thus, it is difficult to economically carry out a bricklaying construction method at a low price, in comparison with the other types of building construction methods suitable for industrial mass production processes. Further, a wall of architecture constructed with bricklaying mehtod can be preferably used as a wall structure of a residential house since it takes desirable architectural design effect, heat accumulation effect and so forth. However, the brick wall structure has a drawback as to an earthquake resistance in comparison to the other kinds of building structures, such as a reinforced concrete structure.

The present inventor et al. have already developed an earthquake resistant bricklaying construction methods in which bricks are stacked in a multiple layer while pre-stress is introduced into the bricks by tightening force of metallic bolts. Those methods have been proposed in Japanese patent applications Nos. 4-51893, 5-91674, 6-20659, 7-172603 and 8-43014.

According to the bricklaying construction developed by the present inventors et. al, bricklaying works can be surely and accurately carried out in a multiple layer formation without depending on the skill of bricklayers, and a brick wall can be made by a dry-construction method. These methods have advantages in that in-situ clean up works and in-situ material transfer works are simplified or relieved while the upper limit in height of executable brick wall per day is substantially raised. In addition, vertical pre-stress is applied to the vertically adjacent bricks by tightening force of the metallic bolts, so that the toughness and strength of the brick wall can be substantially enhanced against temporary horizontal loading. Thus, the bricklaying construction methods by the present inventors et. al enable mass-productive and cost-reductive provision of brick structure houses and the like, and further, those methods are preferably applicable to walls of residential houses and the like so as to effect sufficient earthquake resistance performances.

However, the prior research and study have been mainly directed to bricks adaptable for bricklaying construction of a standard straight wall, whereas the bricks have to be adapted to a wide variety of architectural details and joint structures in practical building structures. For instance, walls of actual buildings are provided with various types of partial structures, such as internal corners, external corners, columnar configurations, openings and so forth, but the bricks which have been studied or researched are not preferably applicable to such architectural details or structures.

It is an object of the present invention to provide a bricklaying structure and a bricklaying method which can be adapted to a variety of building structural details such as corner, opening and columnar configurations.

It is another object of the present invention to provide a brick manufacturing method for manufacturing bricks adaptable to a variety of building structural details such as corner, opening and columnar configurations.

DISCLOSURE OF THE INVENTION

The present invention provides a bricklaying structure which has bricks and metal plates stacked, and fastening means extending through bolt holes of the bricks, the fastening means securely tightened to integrally connect the vertically adjacent bricks under pre-stress, comprising said brick provided with a bolt hole (7;17;27;37;47) of a small diameter vertically extending through the brick and at least two through-holes (8;18;28;38;48) having a diameter larger than the diameter of said bolt hole, wherein said bolt hole has a diameter which allows a bolt (60) constituting said fastening means to extend therethrough, said through-hole has a diameter for containing a nut (70) which can be engaged with said bolt, said bolt hole and through-holes are arranged on a longitudinal center line of said brick in order, and a center of said bolt hole, centers of said through-holes and respective end faces of said brick are spaced apart an equal distance from each other in a longitudinal direction of said brick.

Preferably, the end face of the brick is provided with a vertical groove (9;29;39;49) in a form of semicircle, a center of curvature of the groove is positioned on the center line. The groove defines a vertical channel (80) in cooperation with a vertical groove of an adjacent brick, and the channel has a diameter for containing the nut. More preferably, the through-holes form a vertically continuous hole through which a long bolt (65) of a large diameter can be inserted, when the bricks are laid in a condition that the bricks are alternately oriented at a right angle with each other and that the through-holes are vertically in alignment with each other.

The present invention also provides a bricklaying method in which bricks and metal plates with bolt holes are alternately stacked and small diameter bolts (60) extending through said bolt holes are securely tightened to vertically and integrally connect said bricks with each other, while imposing pre-stress on said bolts, comprising the steps of:

stacking corner bricks (10;20;30;40), each having a through-hole (18;28;38;48) vertically extending therethrough with a diameter of said through-hole being larger than a diameter of said bolt hole (17;27;37;47), so that said through-holes are vertically arranged in order; and inserting through said through-hole, a large diameter long bolt (65) with its diameter being larger than that of said small diameter bolt, and securely tightening said corner bricks by said long bolt.

Further, the present invention provides a bricklaying method in which bricks and metal plates with bolt holes are alternately stacked and small diameter bolts (60) extending through said bolt holes are securely tightened to vertically and integrally connect said bricks with each other, while imposing pre-stress on said bolts, comprising the steps of:

stacking corner bricks (10;20;30;40), each having a through-hole (18;28;38;48) vertically extending therethrough with a diameter of said through-hole being larger than a diameter of said bolt hole (17;27;37;47), so that said bolt holes and said through-holes are vertically and alternately arranged in order; and containing in said through-hole, nuts (70) engageable with said small diameter bolts to securely tighten said corner bricks with said small diameter bolts and said nuts.

Preferably, a straight wall (W) is constructed by laying regular bricks (1), each having a raised center part (2*a*) on its top face and a skirt (4) along a side edge of its bottom face, the corner bricks are laid at a corner part (C) of the wall, and a flat-bottom-type bricks (1') are laid at a portion of the wall at least partially overlapping the corner bricks, the flat-bottom-type brick having a configuration of the regular brick from which the skirt is excluded.

According to the aforementioned arrangement of the present invention, each of the bricks is provided with the bolt hole for insertion of the fastening means, and the bricks are connected with each other under pre-stress by keeping the fastening means through the bolt hole in tensile condition. The brick has a large diameter through-hole with its diameter being larger than the diameter of the bold hole, and the through-hole vertically extends through the brick. In the corner part in which the bricks join together at a predetermined angle with each other, the through-holes are vertically aligned at an intersecting zone (external corner or internal corner) so as to form a vertical hole of a relatively large diameter for inserting the long and relatively large diameter bolt (65) thereinto. The long bolt inserted in the vertical hole is rendered in tensile condition, so that the bricks in the corner are integrally assembled to be structurally stabilized. In an opening frame portion of an opening of the wall at which the wall terminates, or in a deformed wall part such as columnar configuration part, the through-hole and the bolt hole are vertically aligned and arranged vertically in an alternate order. The nut (70) is contained in the through-hole and the bolt (60) of a relatively small diameter is inserted into the bolt hole, the nut and bolt constituting the fastening means. The vertically adjacent bricks are integrally joined under pre-stress by securely tightening the bolt (60) to the nut (70) in the through-hole.

From another aspect, the present invention provides a method of manufacturing a brick used for a bricklaying structure in which the bricks and metal plates are alternately stacked and fastening means extending through bolt holes of the bricks are securely tightened so as to connect the vertically adjacent bricks integrally under pre-stress of the said fastening means, comprising:

forming a bolt hole (7;17;27;37;47) vertically extending through the brick and at least two through-holes (8;18;28;38;48), with the holes being spaced an equal distance from each other on a longitudinal center line of the brick, said bolt hole having a diameter for allowing a bolt (60) of said fastening means to extend therethrough, and said through-hole having a diameter for containing a nut (70) engageable with said bolt, whereby plural sorts of irregular bricks applicable to architectural details of structure are manufactured in dependence on arrangements of said bolt hole and through-holes.

Preferably, a semicircular vertical groove (9;29;39;49) is further formed on an end face of the brick so that the vertical groove defines a vertical channel (80) in cooperation with a vertical groove of an adjacent brick, the channel having a diameter for containing the nut (70) of the fastening means.

According to the present invention, the number, arrangement and combination of the through-hole, bolt hole and semicircular vertical groove are appropriately predetermined or altered, whereby various kinds of corner bricks adaptable to a variety of architectural details can be manufactured. The bolt hole, through-hole and vertical groove are arranged in order along the center line of the brick and the centers of bolt hole and through-holes are located in positions which divide the length of brick into equal sections, e.g., four equal sections. Appropriate setting or revision of the combination of bolt hole, through-hole and vertical groove in correspondence with the object or subject of use allows a variety of corner bricks to be manufactured. This makes it practicable to standardize the production, specification and usage of the bricks. Further, the arrangement of the present invention is advantageous to reduction of drying time of the brick in a drying process, since the entire surface area of the brick is increased by the through-hole and the vertical groove.

BEST MODE FOR CARRYING OUT THE INVENTION

With reference to the attached drawings, preferred embodiments of the present invention is described hereinafter.

Figure 1:
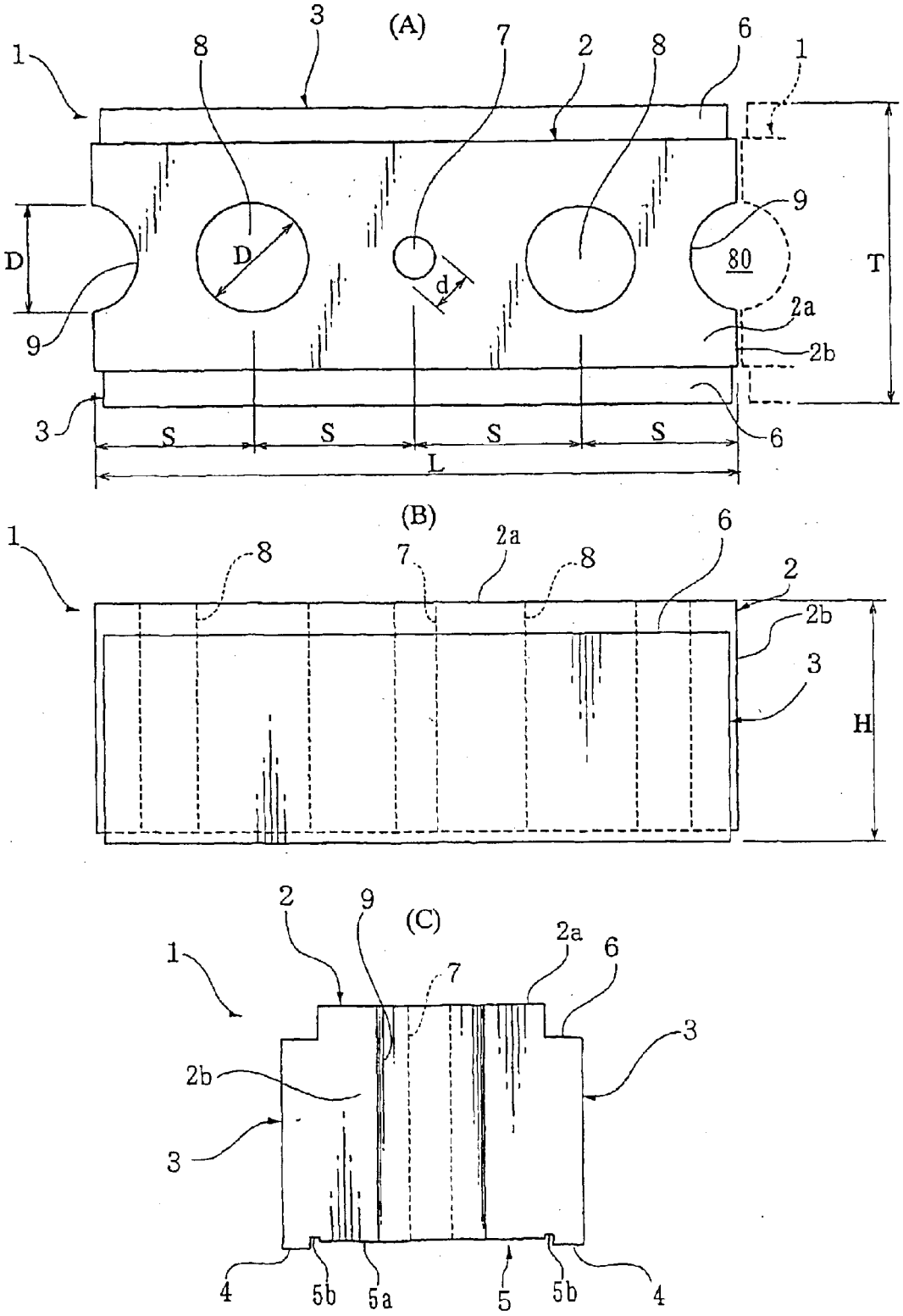
FIG. 1 is an illustration showing a plan, front elevation and side elevation of a profile of regular brick.
Figure 2:
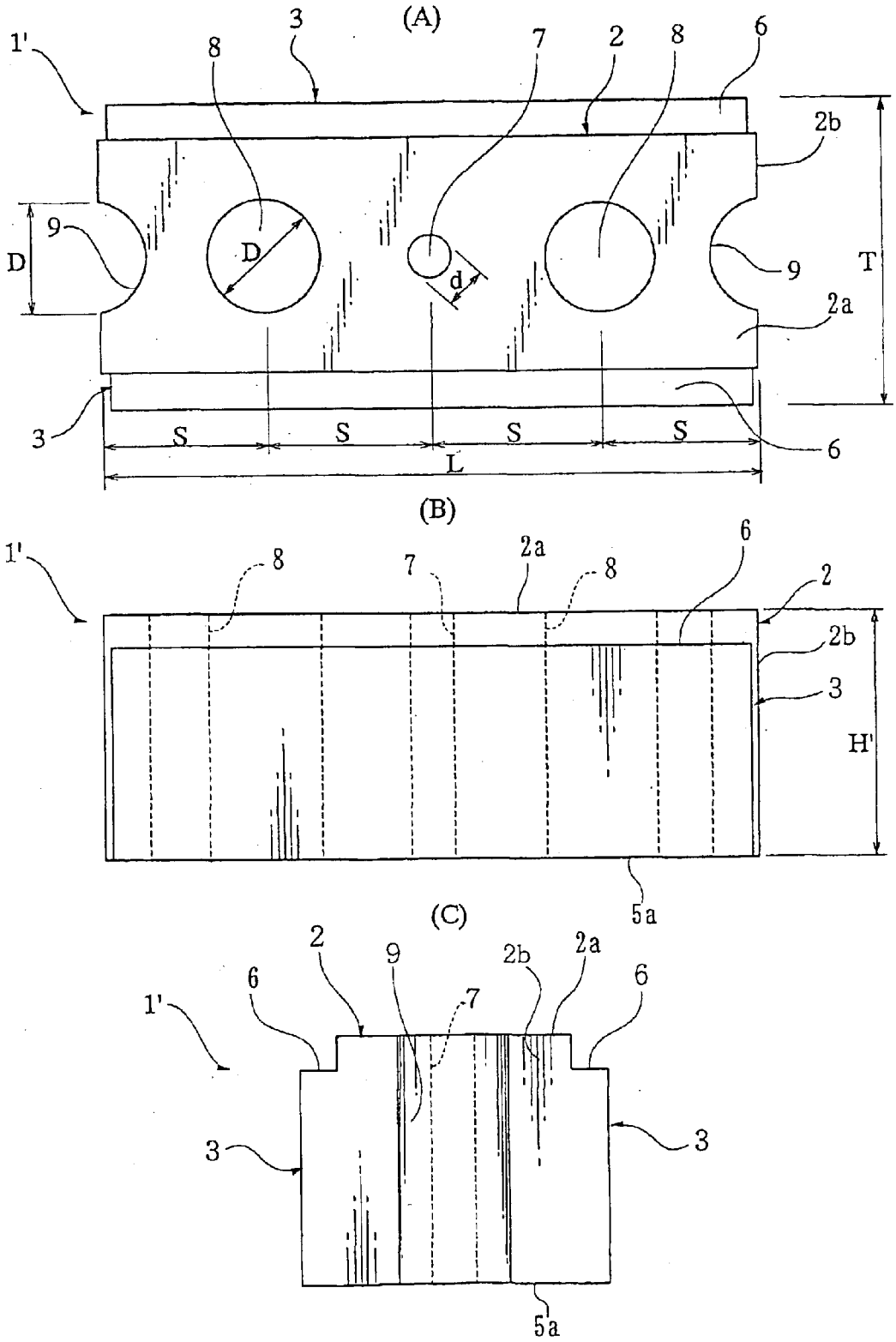
FIG. 2 is an illustration showing a plan, front elevation and side elevation of a profile of flat-bottom-type brick.
Figure 3:
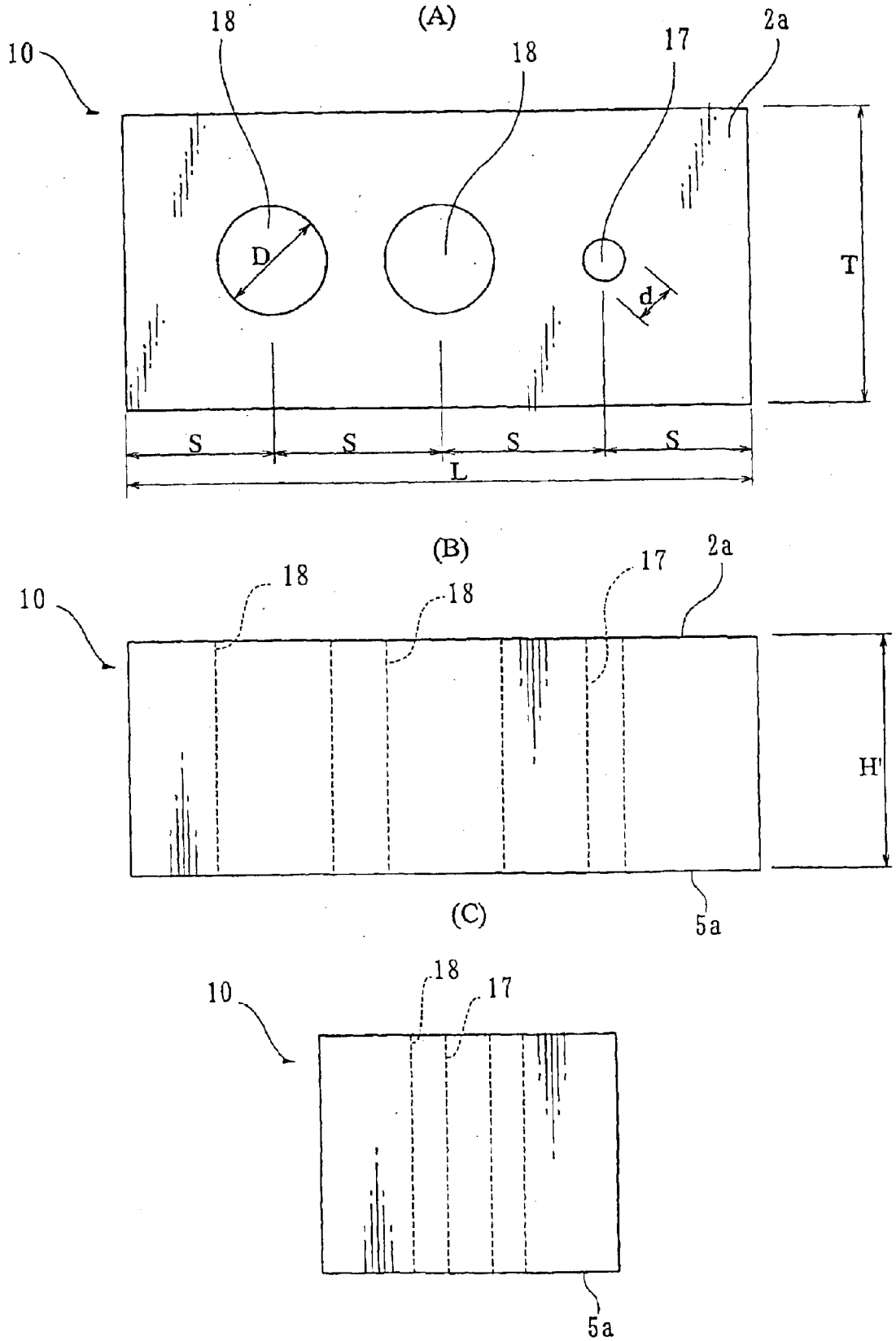
FIG. 3 is an illustration showing a plan, front elevation and side elevation of a profile of first corner brick.
Figure 4:
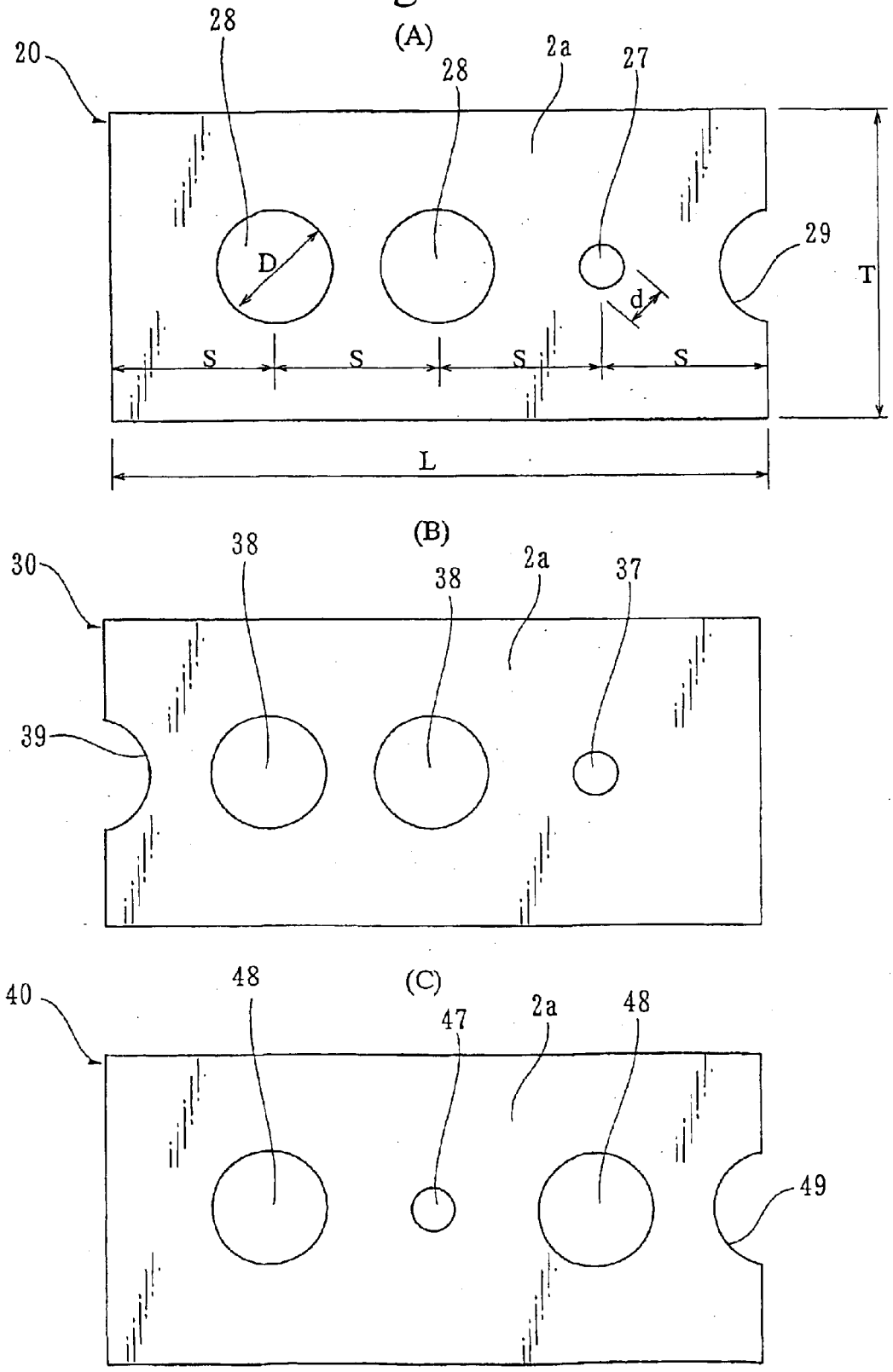
FIG. 4 is an illustration showing plan views of profiles of second, third and fourth corner bricks.
Figure 5:
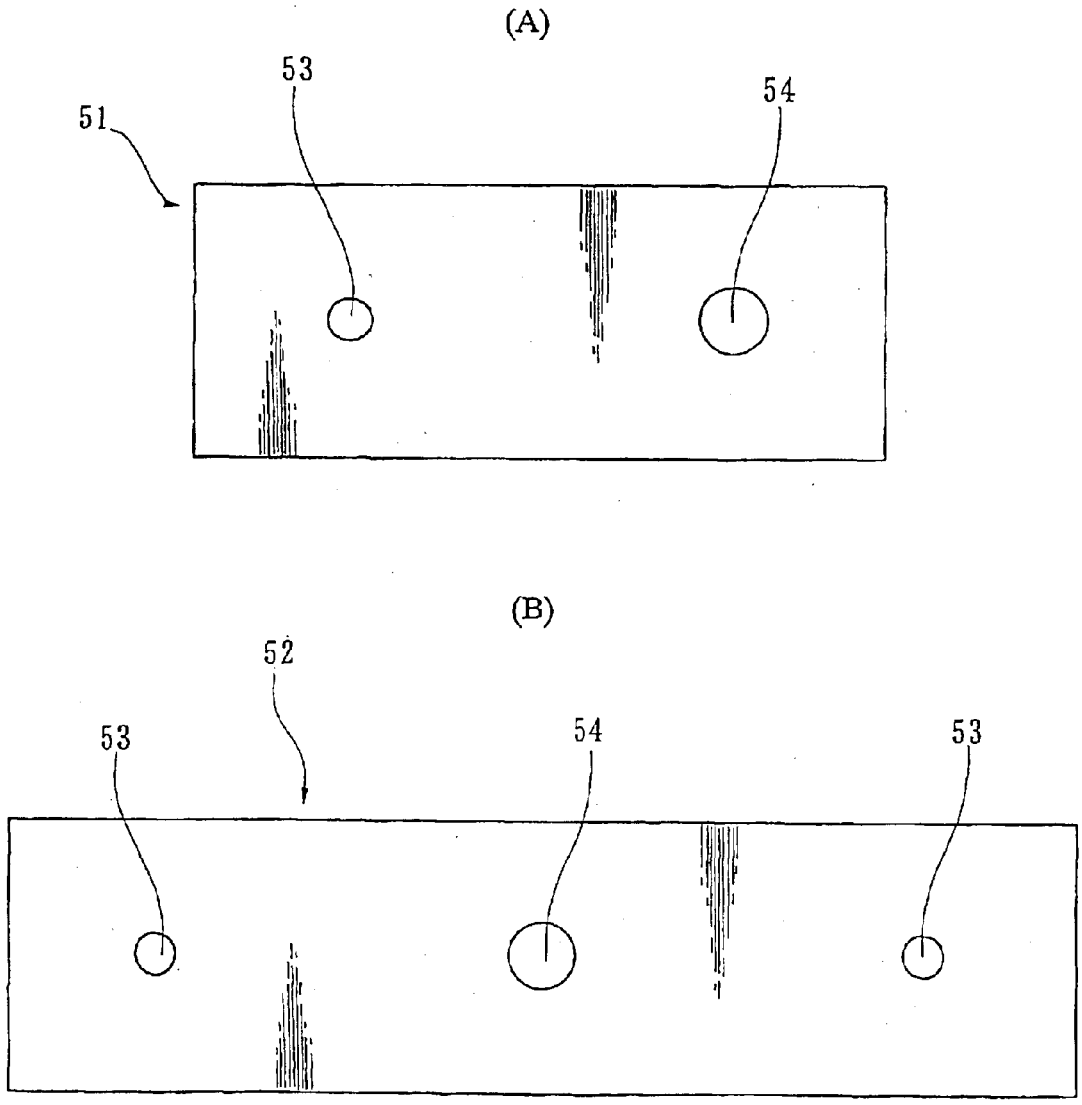
FIG. 5 is an illustration showing plan views of metallic plates.

Various kinds of profiles of bricks are illustrated in plan, front elevational and side elevational views of FIGS. 1 to 4, and the profile of metallic plates inserted between the vertically adjacent bricks are illustrated in a plan view of FIG. 5. A profile of a regular brick is illustrated in FIG. 1, and a profile of a flat-bottom-type brick is illustrated in FIG. 2. In FIGS. 3 and 4, there are shown profiles of irregular or purpose-made bricks used for corner parts, such as an external corner, an internal corner or a columnar configuration.

The regular brick as shown in FIG. 1 is an integrally formed product made from clay by high temperature baking, which has a body portion 2 and offset portions 3 on both sides thereof. The approximate length, width and height are set to be, e.g., 240 mm, 85 mm and 85 mm, respectively. The body portion 2 is provided with a flat top face 2*a* slightly raised from the offset portion 3, and header faces of the body portion 2 slightly protrude from ends of the offset portion 3 in a direction of a center line of wall. When the bricks 1 are laid, a horizontal joint is formed between the vertically adjacent bricks 1 and a vertical joint is formed between the horizontally adjacent bricks 1. If desired, the joints are filled with joint filler such as a sealing compound. The raised section and header face section of the body portion 2 function as backing means for the joint filler when the filler is injected into the joints.

The external surface of the offset portion 3 presents a pattern, color and visual character peculiar to bricks. The offset portion 3 is, e.g., 10 mm to 15 mm in thickness and the total width T of the brick 1 including the offset portion 3 is set to be approximately 110 mm. The length and height of the offset portion 3 are set to be slightly smaller than those of the body portion 2. For example, the offset portion 3 is approximately 230 mm and 75 mm in length and height.

The lower end portion of the offset portion 3 forms a skirt 4 depending from a lower face of the body portion 2 by a distance of 3 to 5 mm. A recess 5 is formed between the skirts 4 on both sides, and the lower face of the bottom portion 2 defines a bottom face 5*a* of the recess 5. Side zones of the bottom face 5*a* are formed with linear grooves 5*b*.

The top and bottom faces 2*a*, 5*b* of the brick 1 are ground by a grinding tool after molding and baking processes. As the recess 5 has a function of parting edges for parting the lower surface of the body portion 2 and the skirts 4, the grinding operation of the bottom face can be limited in an area slightly narrower than the width of the recess 5. Therefore, a grinding tool for the grinding process can relatively easily grind the overall lower face of the body portion 2 to level and flatten the entire area, without wear of the tool by contact with the skirt 4. Thus, the brick 1 is provided with the top face 2*a* and the bottom face 5*b* ground in a grinding process, so that precision of the height of the bricks 1 and accuracy of the bricklaying work in a bricklaying process are substantially improved.

The top face 2*a*, which is elevated from the upper face of the offset portion 3 by 10 to 15 mm as set forth above, is formed with square shoulders 6 of dimension of 10 to 15 mm on both sides of the body portion 2. The shoulders 6 receive the skirts 4 of the upper brick 1 upon bricklaying work, so that a horizontal joint of 5 to 10 mm in size is formed between the vertically adjacent bricks 1. Therefore, sharp edges of the top face 2*a* and the bottom face 5*a*, which are made by grinding for improving the accuracy, are concealed behind the skirt 4, and the edges are invisible from the outside. The overall wall surface of the bricks 1 shows their desired patterns and appearances, and the horizontal joint structure formed by overlapping the skirt 4 and the elevated section acts to effectively prevent leakage of rain water and the like from occurring, which might be, otherwise, caused by its surface tension.

The body portion 2 is provided with a bolt hole 7 of a relatively small diameter, through-holes 8 of a relatively large diameter, and semicircular grooves 9 vertically extending on the both end faces. Centers of curvatures of the hole 7, through-holes 8 and grooves 9 are positioned on a center line of the body portion 2, spaced an equal distance from each other, and the through-holes 8 are disposed in symmetric position with respect to the bolt hole 7. For example, the centers of the circles and semicircles are spaced an equal distance S, which is approximately 60 mm, in a case where the length of L of brick 1 is 240 mm, and a radius d/2 of the bolt hole 7 is, e.g., set to be approximately 4 mm, and a radius D/2 of the through-hole 8 and the curvature of the groove 9 is, e.g., set to be approximately 20 mm.

The through-hole 8 allows the mass of the brick 1 to be reduced for making the lightweight brick 1, and increases the whole surface area of the brick 1 for reduction in drying time of the brick during brick manufacturing process (drying step). Further, the brick 1 with the through-hole 8 having a large diameter is applicable to various types of layout of fastening means (bolts and nuts) in corners of walls, ends of wall, and so forth.

The flat bottom type of brick 1' as shown in FIG. 2 is made by grinding the whole bottom face in a grinding step after forming and baking steps, so that it is not provided with the aforementioned skirt. Therefore, the brick 1' has an overall height H' smaller than an overall height H of the regular brick 1 by a height of the skirt 4. Although the brick 1' differs from the regular brick 1 in that it has an entirely flat bottom face 5*a*, the other structures and specification thereof is substantially the same as those of the regular brick 1.

A configuration of a first form of corner brick 10 (referred to as "first corner brick 10" hereinafter) is generally illustrated in FIG. 3. The first corner brick 10 is an integrally formed product which is produced by high-temperature baking of clay, similarly to the aforementioned bricks 1,1'. However, the first corner brick 10 differs from the bricks 1,1' in that the provision of semicircular groove is omitted from the end face so as to make the brick 10 to be an entire rectangular profile, and the top and bottom faces of the brick 10 are wholly ground in a grinding step after forming and baking steps.

The length L, width T and height H' are set to be, e.g., approximately 230 mm, 110 mm and 85 mm, respectively. The first corner brick 10 is provided with the bolt hole 17 having a relatively small diameter and the through-hole 18 having a relatively large diameter, similarly to the aforementioned bricks 1, 1', wherein the bolt hole 17 and through-holes 18 are arranged in order in a longitudinal direction of the brick 10. The brick 10 differs from the bricks 1, 1' in that the through-hole 18 is positioned at a center of the brick 10. The second through-hole 18 is positioned at a center of one half of the brick 10 and the bolt hole 17 is positioned at a center of the other half of the brick 10. The diameters d and D of the hole 17, 18 are respectively set to be substantially the same as those of the holes 7, 8 (approximately 8 mm and 40 mm).

Second, third and fourth forms of the corner bricks 20, 30, 40 are illustrated in FIGS. 4(A), 4(B) and 4(C) respectively, which are produced in a profile of rectangular shape by high-temperature baking of clay. Each of the first, second and third configurations of bricks 20, 30, 40 (referred to as "second corner brick 20", "third corner brick 30" and "fourth corner brick 40" hereinafter) includes two through-holes 28:38:48 and a single bolt hole 27:37:47, as in the first corner brick 10, but it differs therefrom in that a vertical semicircular groove 29:39:49 is provided on one of end faces. The bricks 20:30:40 have substantially the same dimensions as the first corner brick 10 has, and the diameters d and D of the bolt hole 27:37:47 and the through-holes 28:38:48 are substantially the same as those of the first corner brick 10.

The second corner brick 20 (FIG. 4(A)) has a layout of the holes 27, 28 identical with the layout of the holes 17, 18 of the first corner brick 10. The end face on a side provided with the bolt hole 17 is formed with the semicircular groove. The third corner brick 30 also has a layout of the holes 37, 38 substantially coincident with the layout as in the first corner brick 10. However, an end face on an opposite side in comparison to the second corner brick 20, i.e., the end face of the side provided with the hole 38 is formed with the semicircular groove 39. The fourth corner brick 40 has a layout of the holes 47, 48 identical with a layout of the holes 7, 8 of the regular brick 1. A semicircular groove 49 is formed on only one end face.

Metal plates 51, 52 are shown in FIG. 5, which can be inserted between vertically adjacent bricks. The two-holes plate 51 is illustrated in FIG. 5(A), the plate having a length approximately equal to the length of brick 1. A three-holes plate 52 is shown in FIG. 5(B), the length of plate 52 being one and a half times as long as the length of brick 1. The plates 51, 52 are made to be rectangular thin plates which are approximately 1 mm in thickness, and the width of plates 51, 52 is set to be slightly smaller than the width of body portion 2.

The plates 51,52 are provided with bolt holes 53 of a relatively small diameter and a bolt hole 54 of a relatively large diameter. Normally, the holes 53,54 are alternately positioned. A diameter of the bolt hole 53 is set to be slightly larger than the external diameter of a brick-fastening bolt (FIG. 6), and a diameter of the bolt hole 54 is set to be larger than the diameter of the bolt hole by approximately 6 mm. When the brick-fastening bolt 60 (FIG. 6) is inserted into the hole 54, a sufficient clearance is given in the hole 54 so that positioning of the plates 51, 52 relative to the brick 1 can be simplified by approximately situating the hole 54 and that a setting error of the bolt 60 (inclination or horizontal deviation) is allowable, which may be caused during bricklaying work.

As the other elements, adjuster plates (not shown) having a suitable thickness are used for bricklaying work. In the bricklaying step, several types of metal plates or metal strips having thickness of 2 mm, 3 mm and the like are prepared in advance as being adjuster plates. Such adjuster plates are properly inserted between the vertically adjacent bricks when leveling work of the bricks is required.

Figure 6:
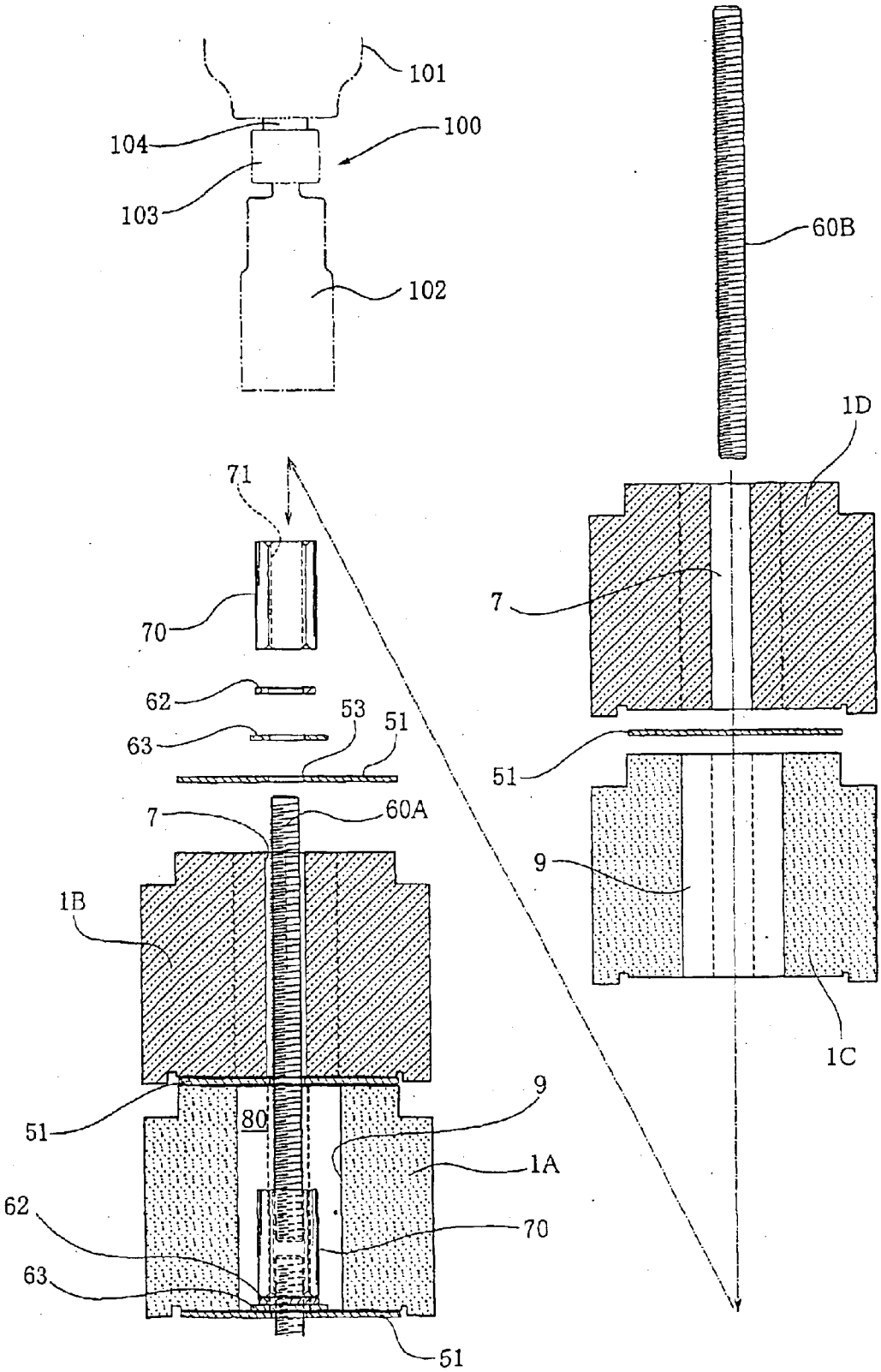
FIGS. 6 through 8 are cross-sectional views and a perspective view showing a bricklaying method.
Figure 7:
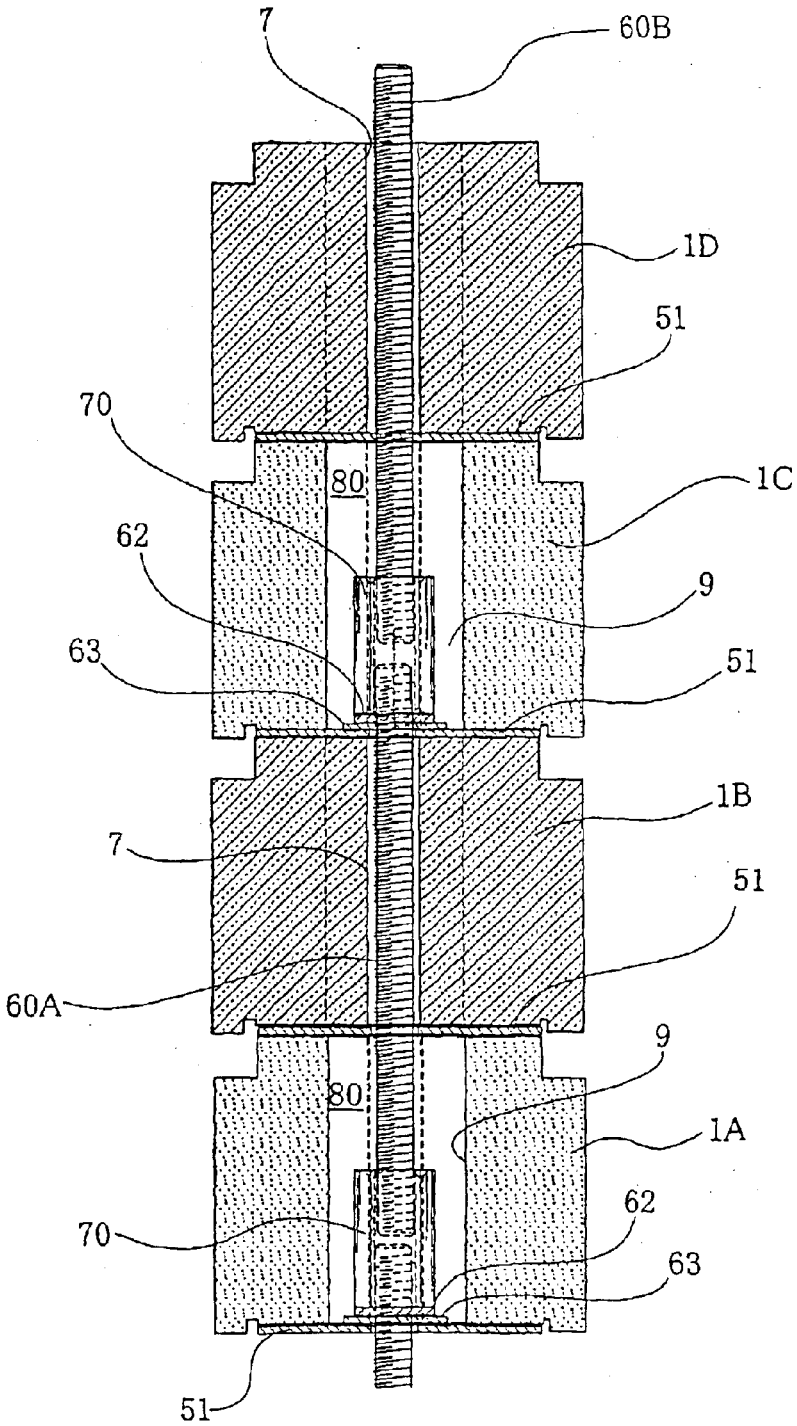
Figure 8:
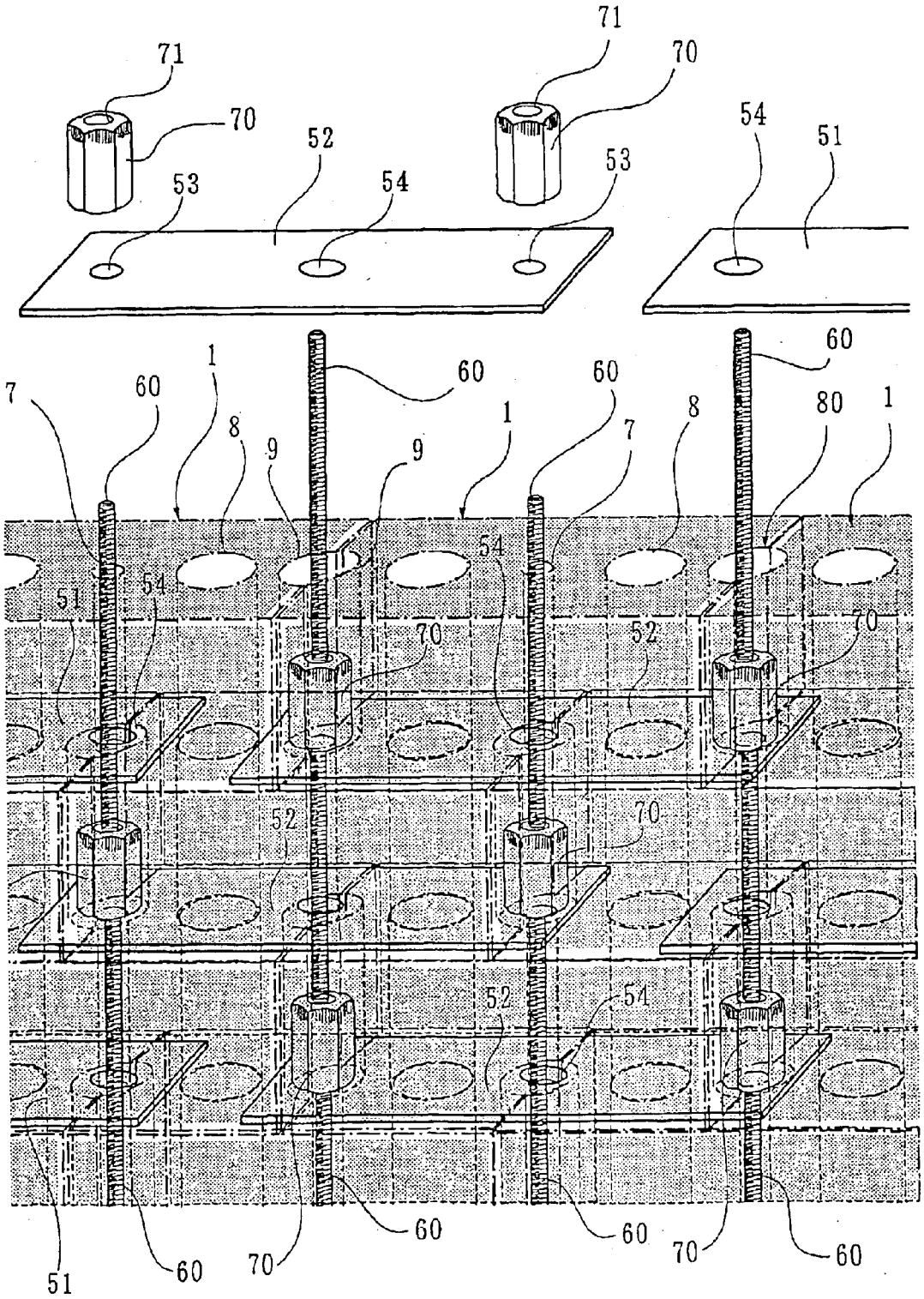

FIGS. 6 through 8 are cross-sectional views and a perspective view showing a standard bricklaying method of the regular brick 1.

The bricks 1 are vertically stacked and the metal plate 51 or 52 is interposed between the bricks 1. The bricks 1 are laid in a staggered arrangement so that the bricks 1 are offset relatively to each other in a direction of wall center by a half length of the brick, as shown in FIG. 8. The semicircular groove 9 of the adjacent bricks 1 in the same level forms the channel 80 having a circular cross-section, in which a long nut or high nut 70 can be contained. The bolt hole 7 of the brick 1 is registered to the center of curvature of the semicircular groove 9 on the upper and lower bricks 1, i.e., the center of channel 80, whereas the through-holes 8 of the bricks 1 are vertically aligned with each other. The holes 53, 54 of the plates 51, 52 interposed between the upper and lower bricks 1 are in alignment with the channel 80 and the bolt hole 7. A fully screw-cut bolts 60 are inserted through the bolt holes 7, channels 80 and holes 53, 54, the bolt 60 having a height (length) substantially equal to the overall height of two-layered bricks. The nuts 70 engageable with the bolt 60 are inserted in the channels 80.

As shown in FIG. 6, the plates 51 are positioned on the upper surface of the brick 1A:1B which has been already laid in position, and a circular washer 63 and a spring washer 62 are positioned on the plate 51 so as to be in registration with the bolt hole 53. A nut 70 is engaged with an upper end portion of the bolt 60A which extends through the hole 53 and washers 63, 62, and protrudes upwardly. The upper end portion of the bolt 60A is tightened to the lower half of an internal thread groove 71.

A specific fixing tool 100 as illustrated by phantom lines in FIG. 6 may be used for tightening the nut 70 onto the bolt 60A. The fixing tool 100 is provided with a portable driving mechanism 101, a socket part 102 selectively engageable with the bolt 60A and the nut 70, and a joint part 103 which can integrally connect the proximal portion of the socket 102 with a rotary shaft 104 of the driving mechanism 101. The socket part 102 receives the nut 70 so as to transmit the torque of the mechanism 101 to the nut 70, thereby rotating the nut in its fixing direction. The nut 70 rotates relatively to the bolt 60A to be securely tightened on the upper end portion of the bolt 60A.

In a succeeding bricklaying step, the bricks 1C for the upper layer are laid on the brick 1B residing in the lower layer. The channel 80 is formed by the semicircular grooves 9 of the adjacent bricks 1C, and the nut 70 is contained in the channel 80. The metal plate 51 is laid on the bricks 1C and the bricks 1D for the still upper layer are further laid on the plate 51. A bolt 60B is inserted into the bolt hole 7 of the brick 1D so that the lower end portion of the bolt 60B is screwed into the nut 70. The aforementioned fixing tool 100 is used for tightening the bolt to the nut 70. The socket part 102 of the tool 100 receives the upper end portion of the bolt 60B to transmit the torque of the driving mechanism 101 to the bolt 60B, so that the bolt 60B is rotated in its fixing direction. As the result, the bolt 60B is securely tightened to the nut 70.

The brick-laid condition of the bricks 1A:1B:1C:1D thus constructed is shown in FIG. 7. The steps of assembling the bricks 1, washers 63, 62, bolt 60 and nut 70 are repeatedly carried out in the layers above the bricks 1C:1D, whereby a continuous wall is constructed with the bricks 1 being integrally laid by the constituents or elements 60:62:63:70 of the fastening means.

Tensile stress in response to the tightening torque acts as pre-stress on the bolt 60 engaged with the upper or lower nuts 70, and compressive stress acts as pre-stress on the brick 1 laid between the upper and lower plate 51, 52. The torque of the bolt 60 and nut 70 in the upper layer transmits to the bolt 60 and nut 70 of the layer immediately thereunder, and acts to further tighten the underside bolt and nut. Therefore, a series of connected bolts 60 and nuts 70 functions in such a manner that the tightening torque of the upper bolts 60 and nuts 70 is transmitted to the lower bolts 60 and nuts 70, and that the lower bolts 60 and nuts 70 are further tightened by a stronger tightening torque as the bricks 1 are laid upwardly. This results in that the pre-stress of a substantially high strength acts on the bolts 60 and the bricks 1 residing in the lower layer, and therefore, that the rigidity and toughness of the wall is substantially improved against the horizontal and vertical external rocking forces.

Figure 9:
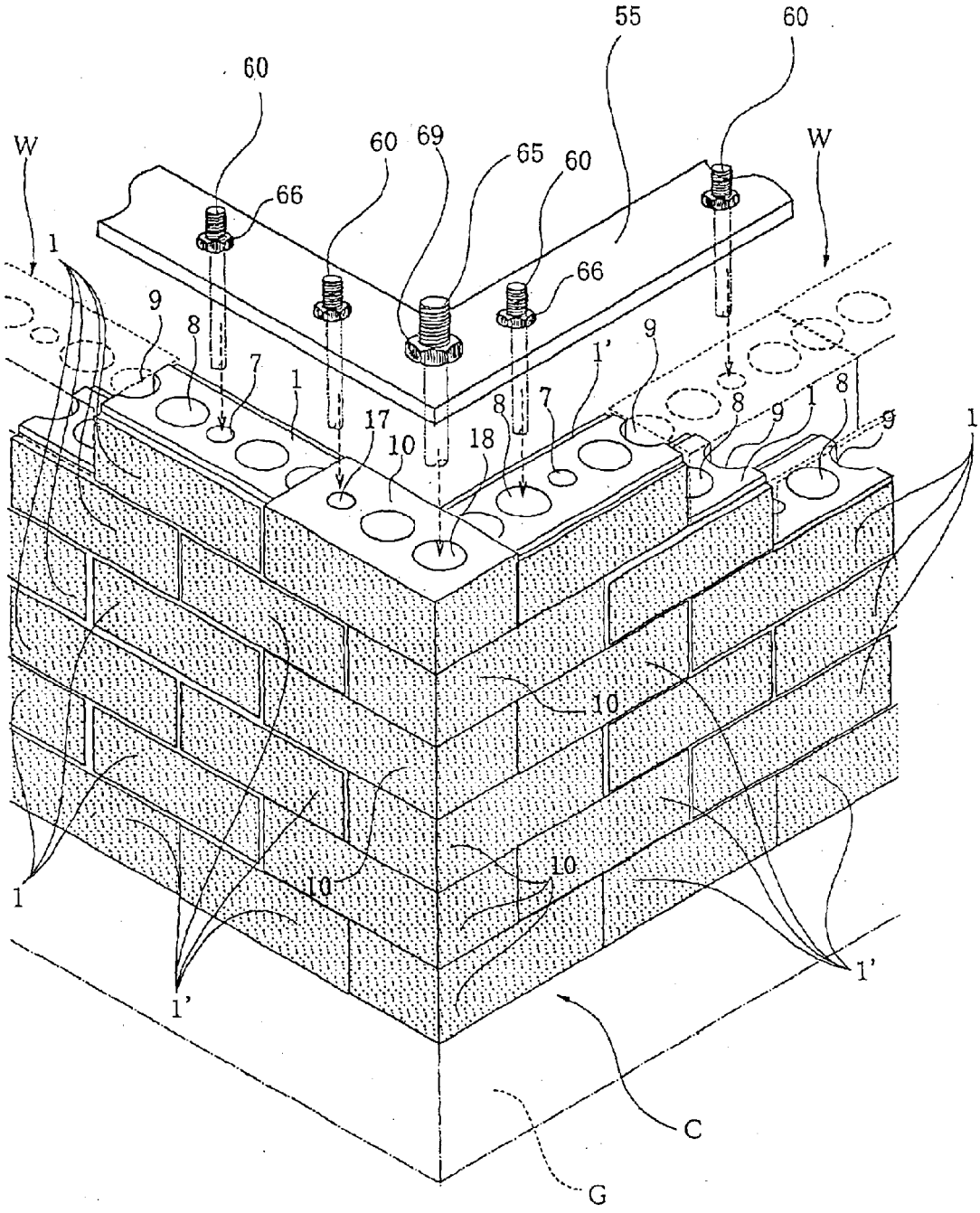
FIG. 9 is a perspective view showing a corner part of wall constructed in accordance with the bricklaying method as shown in FIGS. 6 to 8.

FIG. 9 is a perspective view exemplifying a corner part of the wall constructed by the bricklaying method as shown in FIGS. 6 to 8. For simplification of the drawings, the plates 51, 52 interposed between the respective layers are not shown in FIG. 9.

The walls W of the bricks 1 join together at a right angle to each other in a corner of the building and the like so as to form a corner part C. In the corner part C, the first corner bricks 10 as shown in FIG. 3 are laid at a right angle to each other in an alternate order. The through-hole 18 of the brick 10 positioned at the externally projected corner is vertically aligned with each other to form a continuous vertical hole having a relatively large diameter at the external corner. Long and fully screw-threaded bolts 65, each having a large diameter and a length of approximately 1 meter, are inserted into the hole 18 and connected to each other by long nuts (not shown) in a similar manner as in the aforementioned bolts 60. An L-shaped metal plate 55 is positioned in the uppermost layer of the wall W and nuts 69 are screwed on the bolts 65. The continuously connected bolts 65 are tightened throughout by a high tightening torque when the uppermost nut 69 is screwed on the bolt 65, and pre-stress is introduced into the bolts 65.

Since the corner brick 10 is not provided with the skirt 4 and the shoulder 6, the flat-bottom-type bricks 1' are laid between the corner part C and the straight wall part W constructed by the regular bricks 1. A half of the flat-bottom-type brick 1' overlaps the corner brick 10 and the remaining half of the brick 1' overlaps the regular brick 1. The flat-bottom-type brick 1' is also positioned in the lowermost layer of the wall W which is in contact with an upper surface of the footing G (shown in phantom lines).

According to such steps of bricklaying method in use of the first corner brick 10, the corner part C can be constructed with use of the holes 17, 18 of the brick 10.

In order to desirably give the pre-stress to all of the regular bricks 1 in the bricklaying method with use of the bolt 60 and the nut 70, it is necessary to render the hole 7 and channel 80 (or hole 8) vertically in alignment with each other, preferably, in an alternate order. However, as regards the corner part C with the first corner bricks 10, it might be difficult to impose the pre-stress on some of the regular bricks 1 adjacent to the brick 10, as shown in hatching in FIG. 11(A).

Figure 10:
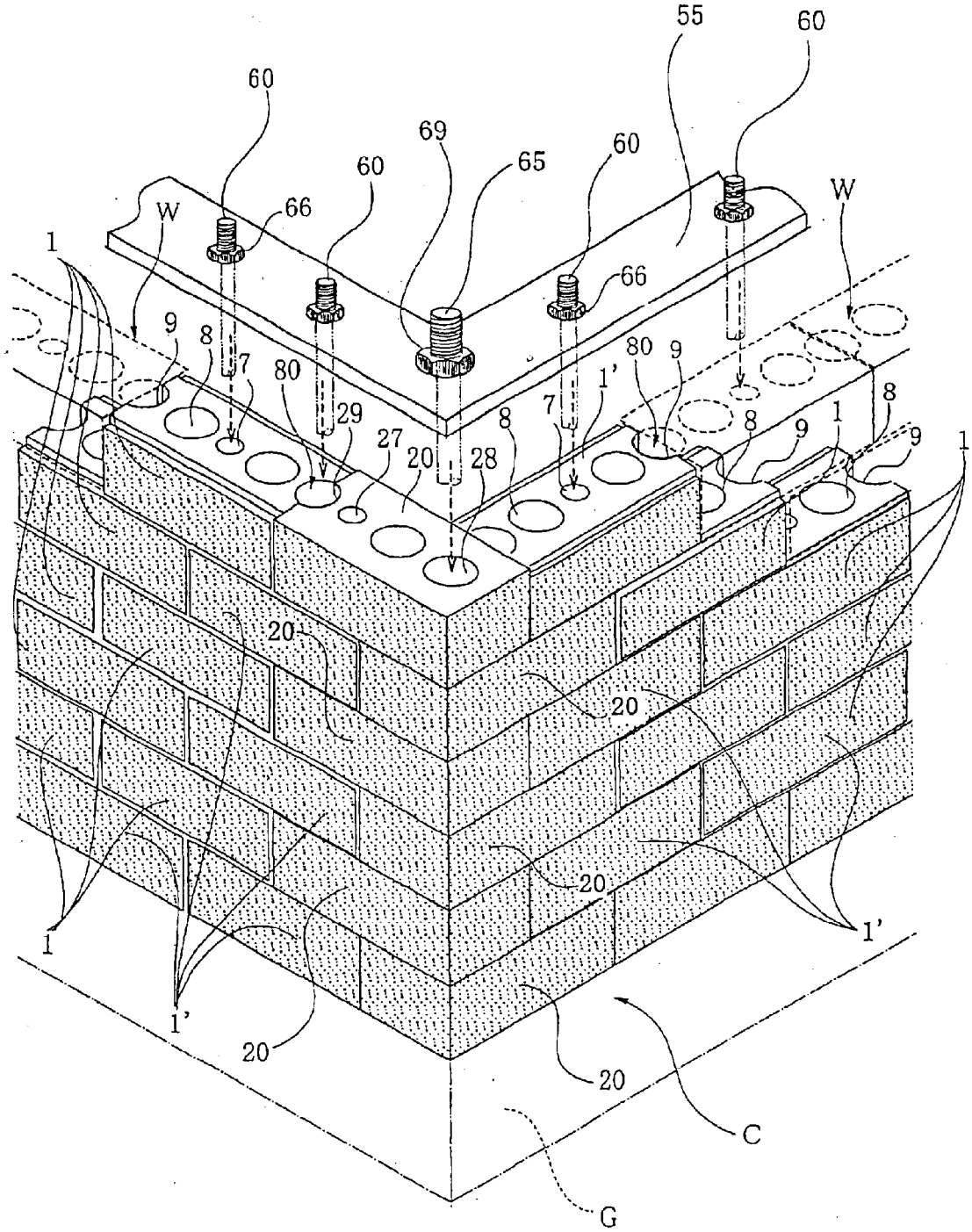
FIG. 10 is a perspective view showing a corner part of wall as an alternative example of that shown in FIG. 9.
Figure 11:
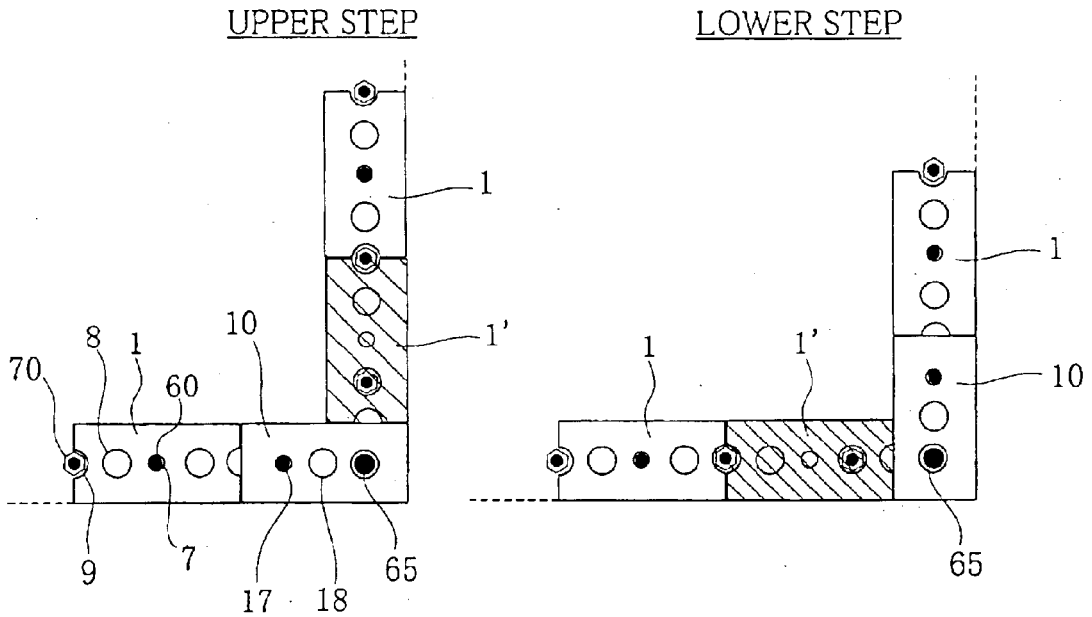
FIG. 11 is an illustration of schematic plan views showing arrangements of bolt holes and channels in the corner part as shown in FIGS. 9 and 10.
Figure 11:
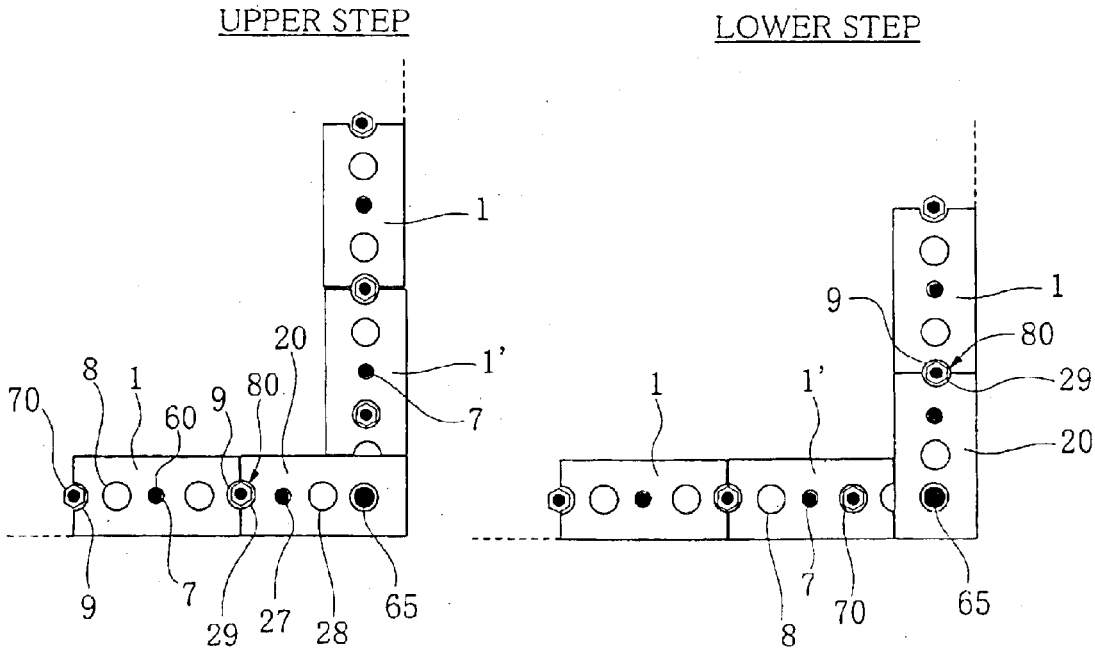

FIGS. 10 and 11(B) are perspective views showing an alternative embodiment of the corner part as shown in FIGS. 9 and 11(A).

With regard to the corner parts C of the wall as illustrated in FIGS. 10 and 11(B), the second corner bricks 20 as shown in FIG. 4(A) are laid at a projecting corner part. In the corner part C with use of the second corner bricks 20, the semi-circular grooves 29 of the bricks 20 define channels 80 for containing the long nut in cooperation with the semicircular grooves 9 of the adjacent brick 1, every second step. Therefore, the bolt hole 7 for inserting the bolt 60 there-through and the channel 80 for containing the nut 70 are provided every second step as shown in FIG. 11(B). Thus, desired pre-stress can be imposed on the bricks 1 adjacent to the second corner bricks 20 by application of the bricklaying structure as shown in FIGS. 6 to 8. The third and fourth corner bricks 30, 40 as shown in FIGS. 4(B) and 4(C) may be laid at the corner part C in an alternate order.

Figure 12:
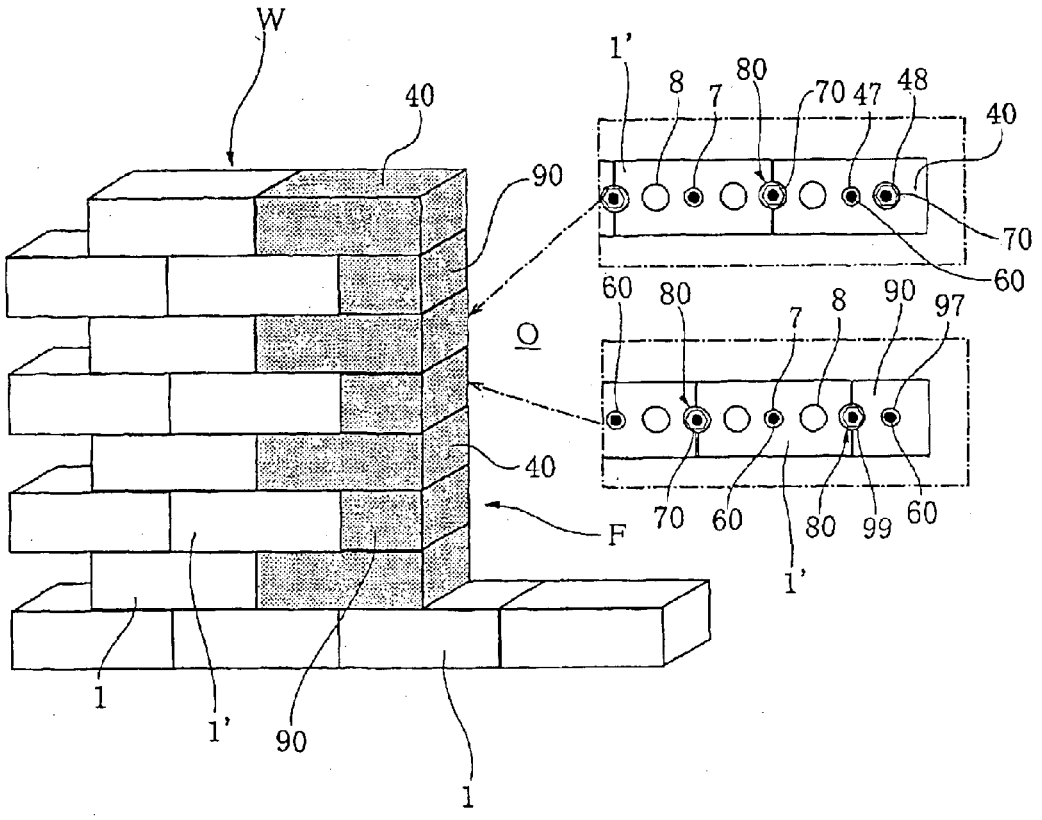
FIG. 12 is a perspective view which exemplifies architectural details around an opening of a single-brick wall constructed in accordance with the bricklaying method as shown in FIGS. 6 to 8.
Figure 13:
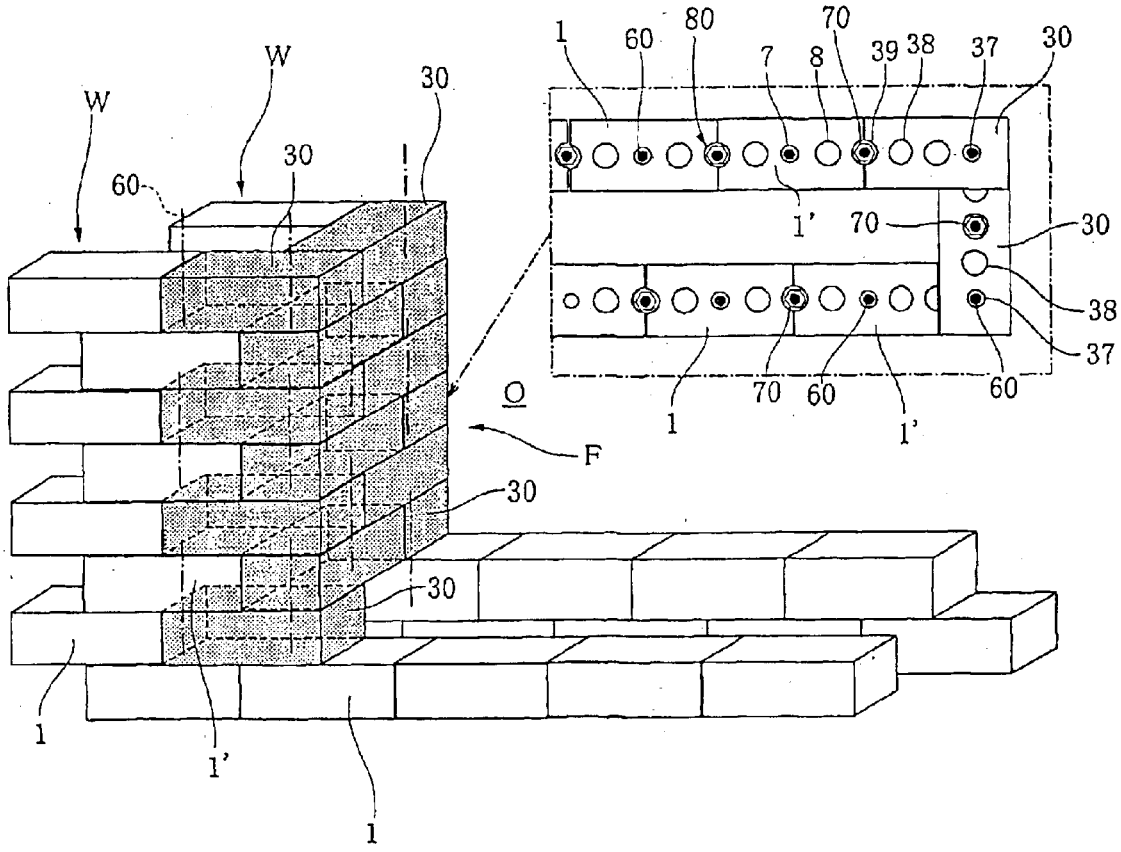
FIG. 13 is a perspective view which exemplifies architectural details around an opening of a double-bricks wall constructed in accordance with the bricklaying method as shown in FIGS. 6 to 8.

FIGS. 12 and 13 are perspective views showing details around an opening of a wall constructed in accordance with the bricklaying method as shown in FIGS. 6 to 8. FIG. 12 is relevant to a single-brick wall with a single row of the regular bricks 1 arranged in alignment with the center line of wall, and FIG. 13 is relevant to a double-bricks wall with double rows of the regular bricks 1 arranged in parallel.

The architectural wall W is provided with various kinds of openings, e.g., openings for window frames, door frames, building utility system and so forth. The fourth corner brick 40 as shown in FIG. 4(C) is used for a frame F of opening in the single-brick wall as shown in FIG. 12. In addition to the bricks 40, regular bricks 1, flat-bottom-type bricks 1' and column bricks 90 are used around the opening of wall. The column brick 90, a plan view of which is generally shown in FIG. 12, has overall dimensions corresponding to a half of the corner brick 40, and is provided with a bolt hole 97 positioned at its center and a semicircular groove 99 on its end face. Since the fourth corner brick 40 does not have the skirt 4 and the shoulder 6, the flat-bottom-type bricks 1' are used in the portion partially overlapping the bricks 40.

As regards the frame portion F for the opening O, bricklaying work starts from the regular bricks 1 to be in the lowermost position of the opening. The bricks 40, 90 are alternately laid so as to make the channels 80, every second step, with use of the semicircular grooves 99 of the column bricks 90 and the groove 9 of the flat-bottom-type bricks 1', and contain the long nuts 70 in the channels 80. The bricks 40, 90 of the opening frame portion F is vertically built-up with use of bolts 60, the nut 70 and the plates 51, 52 in relation to the channels 80 and the bolt holes 47. At the same time, the bolts 60 and the nuts 70 are alternately positioned in the holes 97, 48 and securely tightened with each other. The pre-stress by the tightening force of the bolts 60 and the nuts 70 is imposed on the bricks 40, 90 upon this process, as described above.

On the other hand, the third corner bricks 30 are used to construct the opening frame portion F for the double-bricks wall as shown in FIG. 13. The bricks 30 are laid in an alternate order with use of the bolts 60, long nuts 70 and plates 51, 52 so that pre-stress by the tightening force of the bolts 60 and the nuts 70 is imposed on the bricks 30. The flat-bottom-type bricks 1' are used in the portion partially overlapping the bricks 30 so that the opening frame portion F is formed in continuation with the wall W of the regular bricks 1.

Figure 14:
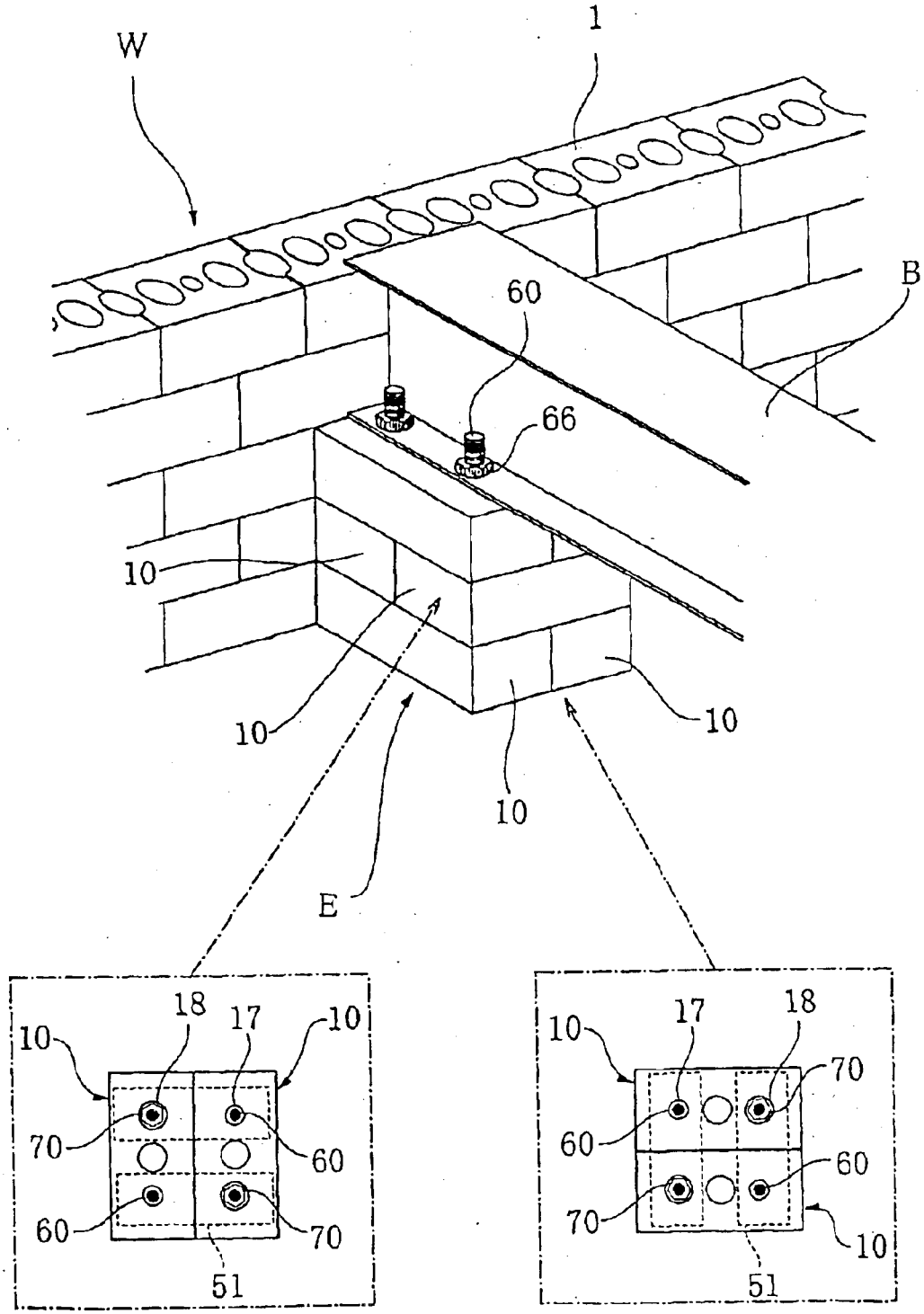
FIG. 14 is a perspective view showing a structure of columnar part constructed in accordance with the bricklaying method as shown in FIGS. 6 to 8.

FIG. 14 is a perspective view showing a structure of column-configured part constructed in accordance with the bricklaying method as shown in FIGS. 6 to 8.

In a case where the wall constructed by the regular bricks 1, especially a single-brick wall, supports a horizontal member B such as a beam or girder constituting a floor structure of second floor, a roof truss or the like, it would be necessary to provide a column-configured part E as shown in FIG. 14 in order to support the load of the horizontal member B.

The column-configured part E as shown in FIG. 14 is constructed by laying a pair of first corner bricks 10 in each step and arranging them at a right angle in turn every step. The bolt hole 17 and through-hole 18 of the first corner brick 10 are arranged vertically in an alternate order and the metal plates 51 are interposed between the bricks 10 in the respective steps.

The bricks 10 are laid while tightening the bolts 60 and nuts 70, and this allows the integral column-configured part E to be constructed while pre-stress are imposed on the bricks 10. A bolt hole at the end of horizontal member B is engaged to a portion of the bolt 60 protruding from the upper end face of the column-configured part E and a nut 66 is securely tightened to the bolt 60 so as to fix the end portion of the member B on the top end of the column-configured part E.

Although the present invention has been described as to specific embodiments, the present invention is not limited to such embodiments, but may be modified and changed without departing from the scope of the invention as claimed in the attached claims.

For instance, the dimensions of the bricks can be appropriately modified in accordance with various kinds of standards, such as a building standard, industrial standard and so forth.

INDUSTRIAL APPLICABILITY

As described above, the present invention can provide a bricklaying structure and a bricklaying method which can be adapted to a variety of building structural details, e.g., corner, opening and columnar configurations.

Further, the present invention can provide a brick manufacturing method of manufacturing bricks adaptable to a variety of building structural details, e.g., corner, opening and columnar configurations.

What is claimed is:

1. A bricklaying structure comprising bricks and metal plates stacked, and fastening means extending through bolt holes of the bricks and metal plates, the fastening means securely tightened to integrally connect the vertically adjacent bricks under pre-stress, wherein each brick is provided with a bolt hole of a small diameter vertically extending through the brick and at least two through-holes having a diameter larger than the diameter of said bolt hole, the diameter of said bolt hole allowing a bolt constituting said fastening means to extend therethrough, said diameter of said through-holes for containing a nut constituting said fastening means, which can be engaged with said bolt, said bolt hole and said through-holes being arranged on a longitudinal center line of said brick, and a center of said bolt hole, centers of said through-holes and respective end faces of said bricks being spaced apart an equal distance from each other in a longitudinal direction of said bricks.

2. The bricklaying structure as defined in claim 1, wherein said end faces of the bricks are provided with a vertical groove in a form of semicircle, a center of curvature of the groove being positioned on said center line, and the vertical groove providing a vertical channel in cooperation with a vertical groove of an adjacent brick, the channel having a diameter for containing the nut.

3. The bricklaying structure as defined in claim 2, wherein said through-holes form a vertically continuous hole through which a long bolt of a large diameter can be inserted when the bricks are laid in a condition that said bricks are alternately oriented at a right angle with each other and that said through-holes are vertically in alignment with each other.

4. The bricklaying structure as defined in claim 1, wherein said through-holes form a vertically continuous hole through which a long bolt can be inserted, when the bricks are laid in a condition that said bricks are alternately oriented at a right angle with each other and that said through-holes are vertically in alignment with each other.

5. A bricklaying method in which bricks and metal plates with bolt holes are alternately stacked and small diameter bolts extending through said bolt holes are securely tightened to vertically and integrally connect said bricks with each other, while giving pre-stress to said bolts, comprising the steps of:

stacking corner bricks, each having a through-hole vertically extending therethrough with a diameter of said through-hole being larger than a diameter of said bolt holes, so that stacked through-holes are vertically arranged in alignment with each other; and inserting, through said through-hole, a large diameter long bolt having a diameter larger than that of said small diameter bolts, and securely tightening said corner bricks by said long bolt.

6. The bricklaying method as defined in claim 5, wherein a straight wall is constructed by laying regular bricks, each regular brick having a raised center part on its top face and a skirt along a side edge of its bottom face, the corner bricks are laid at a corner part of the wall, and flat-bottom-type bricks are laid at a portion of the wall at least partially overlapping the corner bricks, said flat-bottom-type bricks having a configuration of said regular bricks from which said skirt is excluded.

7. A bricklaying method in which bricks and metal plates with bolt holes are alternately stacked and bolts extending through said bolt holes are securely tightened to vertically and integrally connect said bricks with each other, while imposing pre-stress on said bolts, comprising the steps of:

stacking corner bricks, each having a through-hole vertically extending therethrough with a diameter of said through-hole being larger than a diameter of said bolt holes, so that said bolt holes and said through-holes are vertically arranged in an alternate order; and containing in said through-holes, nuts engageable with said bolts to securely tighten said corner bricks with said bolts and said nuts.

8. The bricklaying method as defined in claim 7, wherein a straight wall is constructed by laying regular bricks, each regular brick having a raised center part on its top face and a skirt along a side edge of its bottom face, the corner bricks are laid at a corner part of the wall, and flat-bottom-type bricks are laid at a portion of the wall at least partially overlapping the corner bricks, said flat-bottom-type bricks having a configuration of said regular bricks from which said skirt is excluded.

9. The bricklaying method as defined in claim 7, wherein said corner bricks are arranged in parallel in each step, with corner bricks that are vertically adjacent to each other being oriented at a right angle with each other, and said nuts contained in said through-holes of the corner bricks and the bolts inserted into said bolt holes of the corner bricks are connected with each other so as to make a columnar configuration.

10. A method of manufacturing a brick used for a bricklaying structure in which a plurality of bricks and metal plates are alternately stacked and fastening means extending through bolt holes of the bricks are securely tightened so as to connect the vertically adjacent bricks integrally under pre-stress of said fastening means, comprising:

forming a bolt hole vertically extending through the brick and two through-holes with the holes being spaced from each other on a longitudinal center line of the brick, said bolt hole having a first diameter for allowing a bolt of said fastening means to extend therethrough, said first diameter of said bolt hole being uniform throughout its height, and said through-holes having a second diameter for containing a nut of said fastening means engageable with said bolt, said second diameter of each through-hole being larger than said first diameter and uniform throughout its height.

11. The method of manufacturing a brick as defined in claim 10, wherein said end faces of the brick are each provided with a vertical semicircular groove, and the groove provides a vertical channel in cooperation with a vertical groove of an adjacent brick, the channel having a diameter for containing said nut.

12. The method of manufacturing a brick as defined in claim 10, wherein said bolt hole and said through-holes are formed such that a center of said bolt hole and centers of said through-holes are positioned on said center line, and these three centers and end faces of the brick are spaced an equal distance from each other, so as to be applicable to different architectural details of structure.

13. A bricklaying method comprising the steps of:

stacking bricks and metal plates with bolt holes alternately, each of the bricks having a through-hole vertically extending therethrough with a diameter of said through-hole being larger than a diameter of said bolt holes, so that said bolt holes and said through-holes are vertically alternately arranged;

extending bolts through said bolt holes and containing, in said through-holes, nuts engageable with said bolts; and securely tightening said bricks with said bolts and said nuts to vertically and integrally connect said bricks with each other, while imposing pre-stress on said bolts.

14. The bricklaying method as defined in claim 13, wherein end faces of the bricks are provided with a vertical groove in a form of a semicircle, a center of curvature of the groove being positioned on a longitudinal center line of said bricks, said vertical groove providing a vertical channel in cooperation with a vertical groove of an adjacent brick, the channel having a diameter for containing said nuts, and wherein said bolt holes and said channels are vertically alternately arranged.

* * * * *